United States Patent [19]

Goddard et al.

[11] 4,149,944

[45] Apr. 17, 1979

[54] METHOD FOR ELECTROLYTIC DEPOSITION OF MANGANESE

[75] Inventors: John B. Goddard, Grand Island; Donald J. Hansen, Lewiston, both of N.Y.

[73] Assignee: Union Carbide Corporation, New York, N.Y.

[21] Appl. No.: 784,620

[22] Filed: Apr. 4, 1977

[51] Int. Cl.[2] ..... C25C 1/10

[52] U.S. Cl. ..... 204/105 M

[58] Field of Search ..... 204/105 M

[56] References Cited

U.S. PATENT DOCUMENTS

| | | | |
|---|---|---|---|
| 2,853,444 | 9/1958 | Pye et al. | 204/108 |
| 2,888,390 | 5/1959 | Lapee | 204/108 |
| 2,978,394 | 4/1961 | Moyer | 204/108 |
| 3,034,973 | 5/1962 | Jacobs | 204/105 M |
| 3,696,011 | 10/1972 | Lai | 204/105 M |
| 3,821,096 | 6/1974 | Lai | 204/105 M |

OTHER PUBLICATIONS

J. Applied Chemistry, U.S.S.R. 30(12), pp. 1845–1849 (1957).

J. Applied Chemistry, U.S.S.R. 31(2), pp. 243–247 (1958).

*Primary Examiner*—T. M. Tufariello

*Attorney, Agent, or Firm*—Frederick J. McCarthy, Jr.

[57] ABSTRACT

Method of electrodepositing manganese metal from a manganese metal electrolyte which contains small quantities of sulfur dioxide, selenium and a polyacrylamide compound. The electrodeposited manganese is smoother and exhibits less "treeing", i.e. dendritic growths and high current efficiencies are achieved.

1 Claim, 4 Drawing Figures

METHOD FOR ELECTROLYTIC DEPOSITION OF MANGANESE

The present invention is directed to the electrolytic deposition of manganese. More, particularly the present invention is directed to the electrodeposition of manganese metal from an electrolyte containing additions of sulfur dioxide, selenium and a polyacrylamide compound.

The electrodeposition of manganese is well known and it is also known to introduce sulfur dioxide and selenium compounds into the manganese metal electrolyte in an effort to increase the current efficiency of the electrolytic cell as disclosed in U.S. Pat. No. 3,696,011—Lai. However, as disclosed in the later U.S. Pat. No. 3,821,096—Lai, the practice of U.S. Patent 3,696,011 results in a disadvantageous precipitation of amorphous selenium, which requires the replenishment of relatively expensive selenium, and the relatively high concentrations of selenium required results in selenium contamination of the manganese product. U.S. Pat. No. 3,821,096 attempts to overcome the above-noted disadvantages by using zinc together with lesser amounts of selenium and decreased manganese concentration in the electrolyte.

It is an object of the present invention to provide a method for electrodepositing manganese metal from conventional manganese metal electrolytes at high current efficiency, the manganese metal deposit obtained being sound and generally smooth and free of excessive treeing i.e. dendritic growth.

Figure 1:
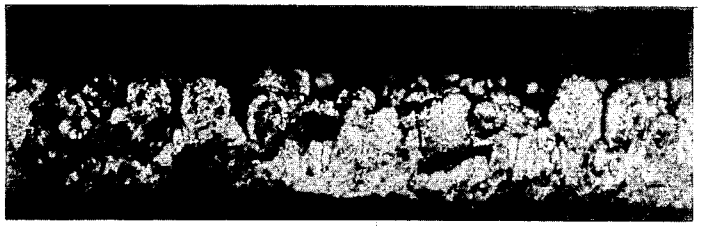
Figure 1A:
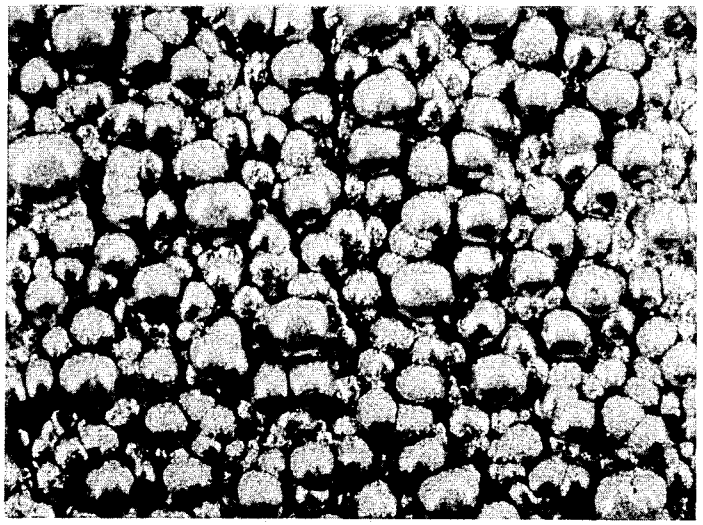
Figure 2:
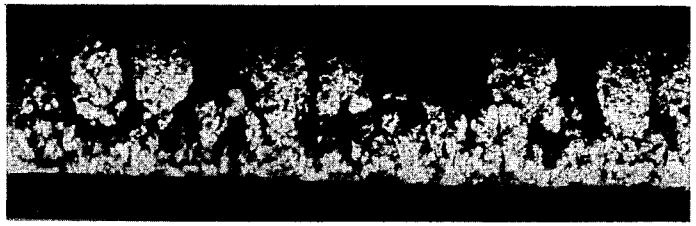
Figure 2A:
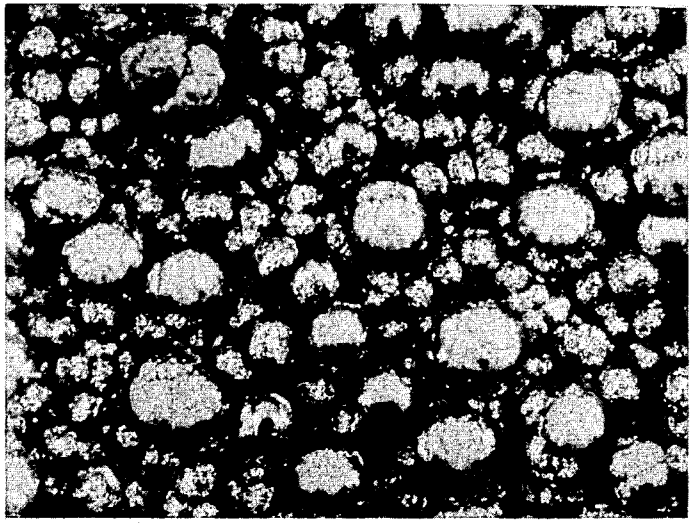

Other objects will be apparent from the following description and claims taken in conjunction with the drawing wherein FIGS. 1(*a*) and 1 show photographs at a magnification of 10X of a top surface and side view respectively of manganese metal product made in accordance with the present invention, and FIGS. 2(*a*) and 2 show similar photographs at the same magnification of manganese metal product made by prior art techniques.

A method in accordance with the present invention is an improvement in electrodepositing manganese metal from an electrolyte containing a source of manganese and comprises introducing into the electrolyte a selenium compound in an amount sufficient to provide from about 0.002 to 0.02 gram per liter of selenium and a polyacrylamide polyelectrolyte in an amount sufficient to provide about 0.1 to 2 mg per liter, and effecting deposition of manganese metal in the presence of sulfur dioxide in an amount of from about 0.1 to 1. grams per liter.

In the practice of a particular embodiment of the present invention, a conventional manganese electrolyte feed solution containing ammonium sulfate and manganese sulfate, with additions of sulfur dioxide, selenium dioxide, and a water soluble polyacrylamide polyelectrolyte in predetermined proportions, is added continuously to the catholyte solution in a conventional electrolytic diaphragm cell, e.g. of the type described in U.S. Pat. No. 2,739,116. The feed solution flow rate is chosen following techniques known to the art to give a desired amount of stripping, i.e. manganese depletion from the electrolyte. The manganese depleted solution passes from the cathode compartment through a diaphragm into the anode compartment, and ultimately exits the cell. The cathodes and anodes may be of any suitable materials, e.g., titanium or stainless steel for cathodes, and lead—1% silver for anodes. Normally because of solubility limits, the feed solution contains about 30–35 g. Mn/l., and this may be stripped, i.e. depleted during electrodeposition to, for example, 10–15 g./l. The ammonium sulfate is used to maintain manganese solubility and can be varied within fairly wide limits, but too little, e.g. less than about 100 g./l. in the feed will cause manganese hydroxide precipitation in the catholyte because of insufficient buffering action, and too much e.g. more than about 150 g./l. in the feed causes a decrease in current efficiency. The preferred amount for manganese concentration of 30–35 g. Mn/l. is about 110–150 g. of $(NH_4)_2SO_4$/l. The amount of sulfur dioxide in the cell feed is 0.1–1.0 g./l., preferably 0.3–1.0 g./l. This can be added conventionally as $SO_2$ gas or as sulfite salts such as $Na_2SO_3$. The selenium addition should be at least 0.002 g./l., and preferably at least 0.005 g./l. The higher selenium additions, e.g., 0.1/g.l, are disadvantageous since selenium is an expensive additive and a relatively high proportion of the selenium addition is precipitated as metal during electrolysis, and cannot be readily recycled to the system. Also, a significant proportion of the selenium codeposits with the manganese, leading to an undesirably impure product with high selenium additions since codeposition of selenium increases in proportion to its concentration in the electrolyte. Consequently, the selenium should be present in the feed solution in an amount from about 0.002 g./l. to about 0.02 g./l. At the upper level of selenium, the manganese metal product contains no more than about 0.10–0.13% Se. The selenium is conveniently added as $SeO_2$, but other selenium compounds such as $SeO_3$, $H_2SeO_4$, $H_2SeO_3$, and selenite or selenate salts can be used. The amount of water-soluble polyacrylamide polyelectrolyte to be added should fall within the range of 0.1–2.0 mg./l., with the preferred range about 0.15–1.0 mg./l. Higher quantities of polyelectrolyte are detrimental to the plating, as the manganese becomes highly stressed under such circumstances and can separate prematurely from the cathode during electrolysis.

The polyacrylamide polyelectrolyte compounds referred to herein are water soluble acrylamide homopolymers with the structure

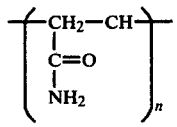

or water soluble copolymers of acrylamide with not more than 25 mole % of other suitable monomers, e.g. acrylic acid, vinyl chloride, and the like. The polymers in water solution may be nonionic, or slighty anionic, e.g. from the hydrolysis of some of the amide groups to carboxyl groups. Typical examples of the polyacrylamides are manufactured by Dow Chemical Company, e.g. Separan NP-10, Separan NP-20, Separan MG-250 (all slightly anionic) and Separan MGL (Nonionic).

The following example will further illustrate the present invention.

EXAMPLE

A small diaphragm cell containing one titanium alloy cathode and two lead-silver anodes, one on each side of the cathode, was operated 48.0 hr. at 18.0A (36A/ft.$^2$ initial cathode current density) at 35° C. The feed to the cell contained 32–34 g. Mn/l. and approximately 130 g. $(NH_4)_2SO_4$/l. The pH was 7.15. Selenium as $SeO_2$, sulfur dioxide as $Na_2SO_3$, and polyacrylamide polyelectrolyte as Dow Chemical Company's Separan NP-10, were added in the amounts recorded in Table I. Feed rates were adjusted as necessary to give a catholyte of approximately 11–14 g. Mn/l. The catholyte pH was about 8.8–9.0.

TABLE I

Manganese Electrodeposition in 48.0 Hr. at 36A/Ft.$^2$, 35° C.

| | Cell Feed Composition | | | | |
|---|---|---|---|---|---|
| Test | q. $SO_2$/L. | q. Se/L | mg Separan NP-10/L | Current Eff. (%) | Metal Characteristics |
| 1 | 0.60 | 0 | 0 | 65.0 | good base, small trees |
| 2 | 0.60 | 0 | 0.88 | 65.4 | thick base, smoother than that of Test 1 |
| 3 | 0.60 | 0.0080 | 0 | 72.2 | thin base, highly treed |
| 4 | 0.60 | 0.0080 | 0.88 | 72.8 | good base, less treed than in Test 3 |
| 5 | 0.60 | 0.0080 | 0.88 | 72.2 | " |
| 6 | 0.40 | 0 | 0 | 66.6 | good base, small trees |
| 7 | 0.40 | 0 | 0.88 | 67.8 | thick base |
| 8 | 0.40 | 0.0050 | 0 | 68.4 | thin base |
| 9 | 0.40 | 0.0050 | 0 | 70.3 | thin base |
| 10 | 0.40 | 0.0050 | 0.88 | 69.5 | thicker base than that of Tests 8–9 |

The metal produced with the selenium and polyacrylamide additions in accordance with the present invention, Tests 4, 5 and 10, was significantly less treed than that produced with only selenium and $SO_2$ additions and high current efficiencies were achieved as compared to the other tests. The thin based metal from the selenium-only Tests 3, 8 and 9, was substantially all trees. This condition is very detrimental in large scale commercial practice; often the treeing is even more intense because of generally unequal current distribution to the cathodes and the trees tend to fall off and redissolve in the electrolyte, frequently when the cathode is extracted from the cell. Also, large trees tend to redissolve at their base while still attached to the cathode. These phenomena can result in a net decrease in current efficiency, which, in turn, translates to increased power costs per pound of metal produced. FIGS. 1 and 1(*a*) showing photographs of the manganese metal product obtained in Test 5 in accordance with the present invention ($SO_2$, Se, polyacrylamide additions) exhibit the minimal "treeing" and thick, sound metal base achieved in the practice of the present invention. FIGS. 2 and 2(*a*) show the metal product of Test 3 ($SO_2$, Se additions) which exhibits gross "treeing", cracking and a thin base.

What is claimed is:

1. In a method for electrodepositing manganese metal from an electrolyte feed solution containing 30 to 35 grams per liter of manganese and 110 to 150 grams per liter $(NH_4)_2$ $SO_4$, the improvement which comprises introducing into the electrolyte a metal additive consisting essentially of a selenium compound in an amount sufficient to provide from about 0.005 to 0.02 gram per liter of selenium and a polyacrylamide polyelectrolyte in an amount sufficient to provide about 0.15 to 1 mg per liter and effecting deposition of manganese metal in the presence of sulfur dioxide in an amount of from about 0.3 to 1 gram per liter.

* * * * *

UNITED STATES PATENT AND TRADEMARK OFFICE

CERTIFICATE OF CORRECTION

PATENT NO. : 4,149,944

DATED : April 17, 1979

INVENTOR(S) : John B. Goddard and Donald J. Hansen

It is certified that error appears in the above-identified patent and that said Letters Patent are hereby corrected as shown below:

Column 1, line 6, after the word "More", delete the comma and insert a comma after the word "particularly".

Column 1, line 51, delete "1." and substitute therefor --1.0--.

Column 2, line 19, delete "0.1/g.1" and substitute therefor --0.1g./l.--.

Column 3, in Table I delete the column headings "q. $SO_2$/L." and "q. Se/L" and substitute therefor --g. $SO_2$/L-- and --g. Se/L--, respectively.

Signed and Sealed this

*Twenty-ninth* Day of *October 1985*

[SEAL]

*Attest:*

*Attesting Officer*

DONALD J. QUIGG

*Commissioner of Patents and Trademarks—Designate*